US005402872A

United States Patent [19]

Clurman

[11] Patent Number: 5,402,872

[45] Date of Patent: Apr. 4, 1995

[54] ENVIRONMENTAL PROTECTIVE AMUSEMENT AND VENDING METHOD AND APPARATUS

[76] Inventor: Grant G. Clurman, P.O. Box 11557, Reno, Nev. 89510

[21] Appl. No.: 22,969

[22] Filed: Feb. 25, 1993

[51] Int. Cl.[6] ..... G07F 7/06

[52] U.S. Cl. ..... 194/209; 221/66

[58] Field of Search ..... 194/205, 208, 209, 212, 194/213; 273/138 A; 221/66

[56] References Cited

U.S. PATENT DOCUMENTS

| | | | |
|---|---|---|---|
| 4,784,251 | 11/1988 | DeWoolfson et al. | 194/209 |
| 5,085,308 | 2/1992 | Wilhelm | 194/209 X |
| 5,152,387 | 10/1992 | Hammond | 194/208 |

FOREIGN PATENT DOCUMENTS

| | | | |
|---|---|---|---|
| 0303137 | 2/1989 | European Pat. Off. | 194/209 |
| 2612320 | 9/1988 | France | 221/66 |
| 85/03790 | 8/1985 | WIPO | 194/213 |

*Primary Examiner*—F. J. Bartuska

*Attorney, Agent, or Firm*—Herbert C. Schulze

[57] ABSTRACT

A method and apparatus for providing for the destruction of used beverage containers while at the same time providing slot machine simulating amusement wherein a slot machine resembling apparatus receives the used beverage container and by activation of slot machine simulating apparatus the beverage container is destroyed and collected for ultimate recycling, and vending a new beverage container containing fresh beverage or a prize.

2 Claims, 3 Drawing Sheets

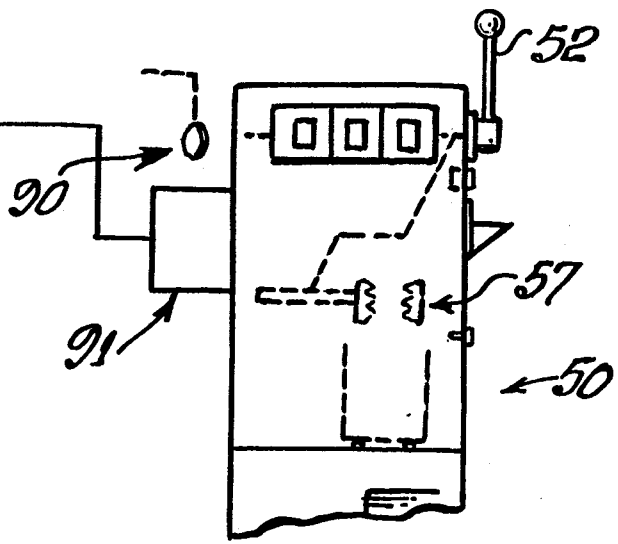
Fig. 6.
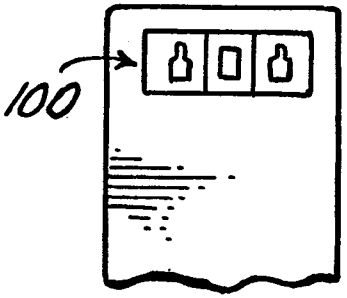
Fig. 5.
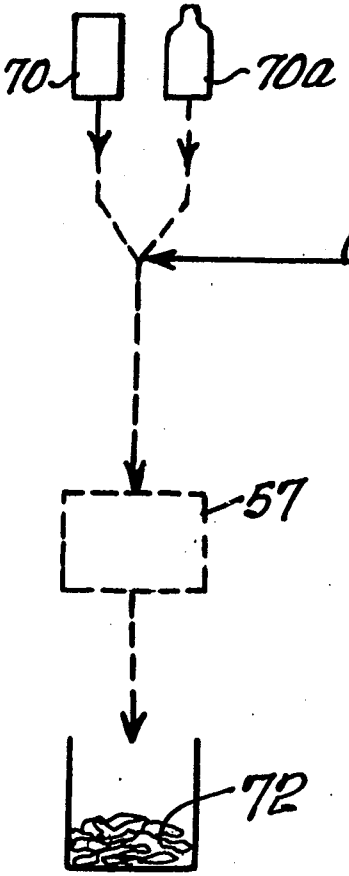

ENVIRONMENTAL PROTECTIVE AMUSEMENT AND VENDING METHOD AND APPARATUS

CROSS REFERENCE TO RELATED APPLICATIONS

There are no patent applications filed by me related to this patent application.

BACKGROUND OF THE INVENTION

I. Field of the Invention

This invention is in the general field of vending machines for beverages and the like and also in the field of proper environmental disposal of used containers;

The invention is even more particularly directed to the disposal of used containers and dispensing of fresh containers of beverage or the like;

The invention is even more particularly directed to such a method and apparatus wherein beverages or the like may be dispensed as a reward in connection with proper disposition of used containers; and The invention is most particularly related to such a method and apparatus wherein an entertaining game is played in connection therewith.

II. Description of the Prior Art

There have been various devices suggested for economical disposition of used containers of beverages, foods, and the like. Such items include can crushers, plastic shredders, and the like.

Likewise, there are numerous vending machines for the vending of beverages and the like contained in disposable containers.

To my knowledge, however, there has not been a combination of a used container disposal system cooperatively operated in connection with the vending of beverages or the like, and particularly wherein an entertaining game is played in connection with such vending and disposition of used containers. In this respect, the present invention is believed to be totally unique and without prior art.

SUMMARY OF THE INVENTION

Beverage containers are used throughout the world in large quantities and are frequently dispensed in vending machines in public, as well as private, places. It is not uncommon for the beverage containers, whether of metal or plastic, to be discarded on streets and highways and other property in such manner as to create an environmental problem.

I have studied this problem at length and have now conceived a method and apparatus which will encourage the proper disposal of beverage containers in such manner as to provide the material from which they are made to be compacted for recycling purposes as well as providing amusement and the proper vending of a new beverage in a new container, as desired.

I accomplished this highly desired end result by the use of an amusement device resembling a slot machine which will accept old beverage containers for destruction and compaction for recycling, at the same time providing the amusement of operating a device which appears to be a slot machine, and at the same time which can provide a new container of beverage.

I know of no combination of vending machine and container disposition in cooperative relationship; Particularly, I do not know of any such development wherein an entertaining game is played at the same time.

I have devised a method and apparatus for practicing the method, wherein one desiring to obtain a beverage or the like from a vending machine may activate a game, such as a slot machine, or simulated slot machine, while disposing of a used beverage container and, depending upon the results of a game, receive a free filled container from the vending machine, or some other prize for having contributed to an environmentally sound disposition of an old container.

I have accomplished this by combining a slot machine type (or slot machine simulating) device with an effective disposal and storage apparatus for beverage cans, or the like, This has been accomplished by making the game play dependent upon the simultaneous disposition of a used container. In this method, a proper alignment of items in the slot machine type mechanism may automatically dispense a new container of beverage, a token, some other prize or award, or the like as the used container is being disposed of.

In instances where the play of the slot machine does not result in the dispensing of a new container, the player of the game may obtain a new container of the beverage by insertion of appropriate coins, or the like.

It is an object of this invention to provide a method and apparatus for environmentally proper disposition of used beverage containers or the like concurrent with the activation of a game mechanism;

Another object of the invention is to provide for proper environmental disposition of a beverage container or the like while vending a fresh beverage or the like;

Another object of this invention is to provide a method and apparatus as outlined wherein old beverage containers and the like are compacted in order to be stored in minimum space pending final disposition, The foregoing and other objects and advantages of this invention will become apparent to those skilled in the art upon reading the description of a preferred embodiment in conjunction with a review of the appended drawings.

It is an object of this invention to provide an environmental protective apparatus for disposing of used beverage containers;

Another object of this invention is to provide a method and apparatus as described by which one can engage in an amusement game while disposing of a beverage container;

Another object of this invention is to provide a dispensing apparatus which can dispense a new beverage container as desired while disposing of an old empty beverage container.

The foregoing and other objects and advantages of this invention will become apparent to those skilled in the art upon reading the description of a preferred embodiment which follows, in conjunction with a review of the appended drawings.

BRIEF DESCRIPTION OF THE DRAWINGS

FIG. 5 is a schematic flow chart showing the operations of the device of FIGS. 3 and 4; and FIG. 6 is an illustration of the symbols which might be shown in the operation of the device.

DESCRIPTION OF A PREFERRED EMBODIMENT

Figure 1:
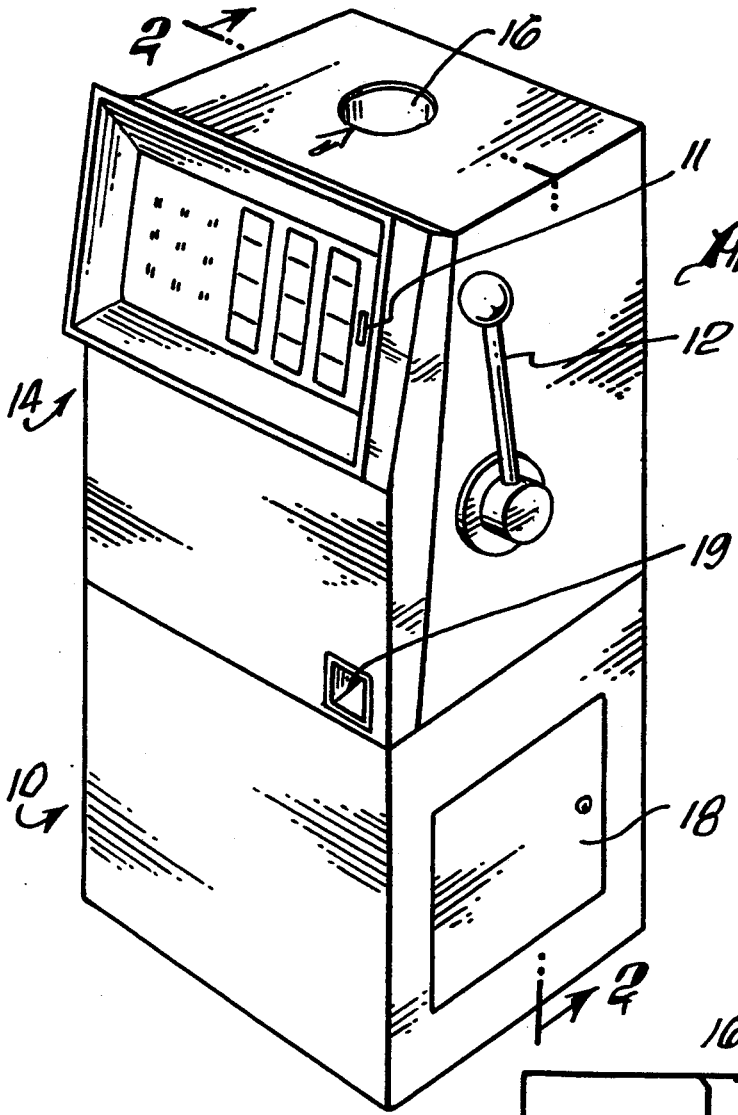
FIG. 1 is a schematic perspective of a device suitable to practice the method of this invention.

FIG. 1 illustrates a device comprising a housing generally 10, having a front upper panel generally 14 which resemble a slot machine, including a slot 11 for reception of a coin or token as desired. An opening 16 in the top of cabinet is suitable to accommodate a beverage container or the like. Handle 12 may be used to activate the device. The side door panel 18 is used for access to the interior on the cabinet for maintenance and for removal of discarded containers.

Figure 2:
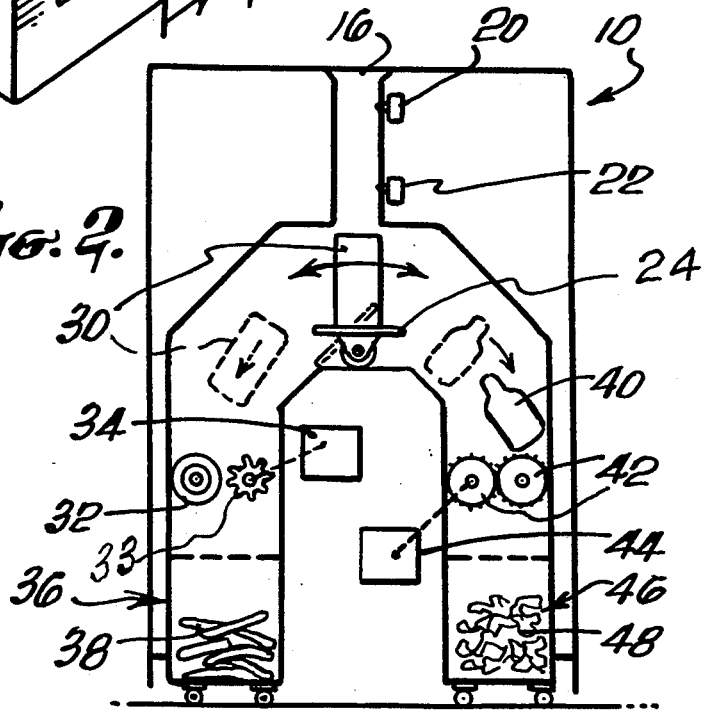
FIG. 2 is a schematic section through 2—2 of FIG. 1.

FIG. 2 shows sensors 20 and 22 which can detect (by means known to those skilled in the art) the material from which a container passing through opening 16 is made. An aluminum container 30 has been detected and is resting on the platform 24. When the handle 12 is activated the platform 24 will tilt to the position shown in phantom and drop the container 30 as shown in phantom. The aluminum container will then be crushed by mechanisms known to those skilled in the art and indicated in this case as a roller 32 and crushing sprocket 33 activated by motor 34. Crushed cans 38 will accumulate in a bin as indicated . This bin can be mounted on rollers or the like and removed through a door (not shown) in the cabinet.

On the right side of FIG. 2 there is an illustration of the situation if a plastic container has been sensed by the sensors 20–21. In this case, the platform 24 will have tilted to right and the plastic container 40 will be shredded by means known to those skilled in the art by the shredder 42—42, activated by motor or the like 44, in turn activated by the handle 12 through appropriate connections dictated by the sensors. Alternatively both the can crusher and the bottle shredder could activate each time the handle is activated. Obviously in this latter case, one side would be idling. Shredded plastic or the like 48 will accumulate in bin 46 for ultimate removal through the door 18, or another opening (not shown).

Figure 3:
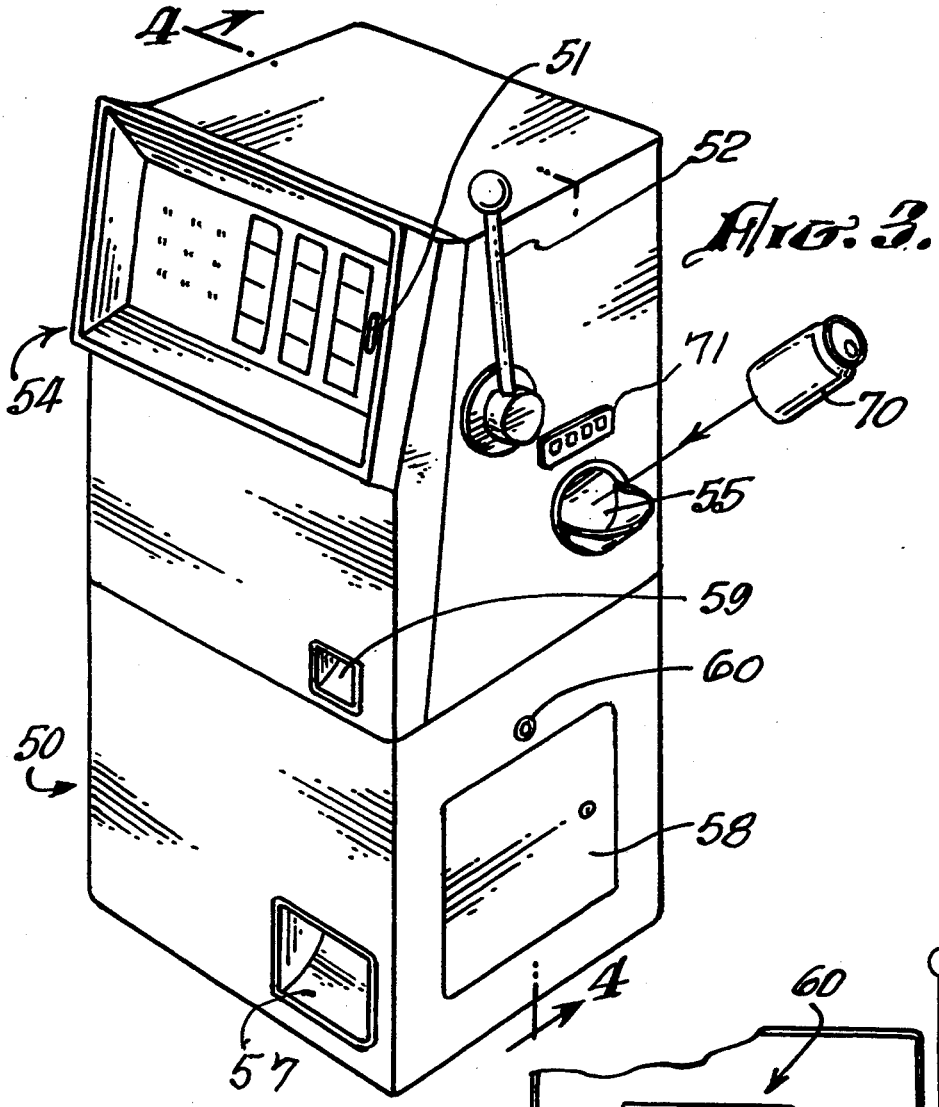
FIG. 3 is a schematic perspective of an alternate embodiment of device suitable to practice the method of this invention.

FIG. 3 shows an alternate embodiment comprising a cabinet 50, front panel 54, resembling a slot machine, activating handle 52 container receiving opening 55 coin or token receiving slot 51, token or prize dispensing opening 59, beverage container dispensing opening 57, crushed container bin door 58, bin level indicator 60, and activity indicators 71. A beverage container 70 is shown about to be placed in the opening 55.

Figure 4:
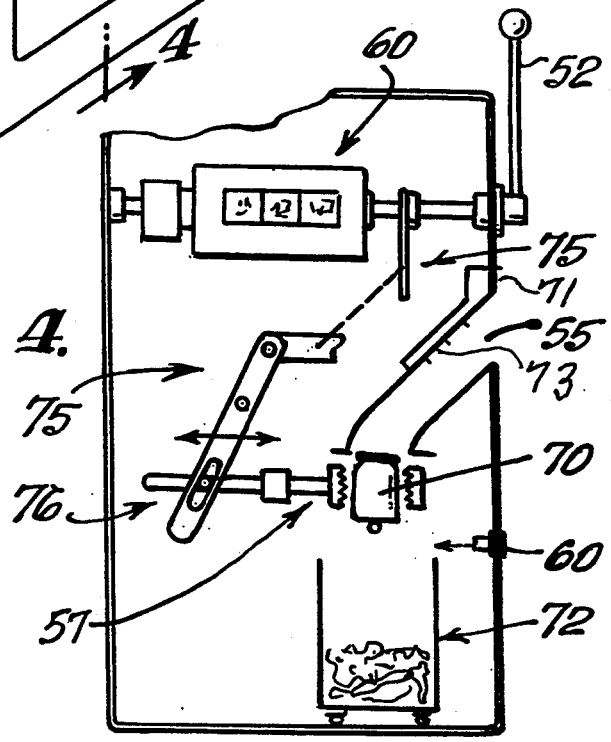
FIG. 4 is a schematic section through 4—4 of FIG. 3.

FIG. 4 shows some of the elements described in connection with FIG. 3, and adds other features. The activating lever 52 activates slot machine like reels 60 in a manner known to those skilled in the art. At the same time the activation of lever 52 will activate container crusher or shredder 57 through linkage 75–76, either directly, or by activation of a power device. The details of either will be known to those skilled in the art. Sensors 73 can be used to display, at 71, the type of material being used, and can, also, deactivate the machine if it is desired not to destroy that particular item at that time. As the destroyed containers accumulate in bin 72, the amount of material in the bin can be weighed, or its volume sensed by photo-electric means , or the like. When a predetermined amount of destroyed material has accumulated, an alarm, or visual indicator at 60 will be activated. When this occurs, the destroyed material in bin 72 may be automatically, or manually removed from the cabinet As desired, the activation may be by the insertion of the used container, by use of a coin or token, or by a combination thereof. The details of this type construction and activation will be known to those skilled in the art.

As desired, the activation of the machine and destruction of the used container may be utilized to selectively give a prize, as determine by the spin and final stopping position of the slot machine type reels. Also, the using of a coin or token can be necessary to receive a new beverage, or to play the game.

FIG. 5 shows how the signalling of the deposit of a container in conjunction with deposit of a token 90 can be utilized to cooperatively activate the reels when handle 52 is activated, thus activating reels to give a final display as at 100 in FIG. 6. The display can be of environmental symbols or the like to provide educational as well as entering results.

It should be noted that FIG. 6 only shows what one set of reels might show. However, it should be noted that in FIGS. 1 and 3 there is provision for a larger number of possible reel and display elements, if desired.

In the utilization of this invention, the following steps can be considered: Step 1—a beverage container or the like is inserted into a mechanism capable of disposing of the container; Step 1a ( optional )—a coin or token is inserted into the mechanism; Step 2—a slot machine type display is activated simultaneously with the activation of container destruction means; Step 2a ( optional )—a new container of beverage, or a prize, or both is dispensed depending upon the results of the spin of the slot machine type reels; Step 3—destroyed containers are removed from the machine.

While the embodiments of this invention, shown and described, are fully capable of achieving the objects and advantages, it is to be understood that such embodiments are for purposes of illustration only and not for purposes of limitation.

I claim:

1. The method of disposing of used beverage containers comprising: placing a used beverage container on a tiltable platform within a machine equipped with beverage container destructing means and slot machine like reel means and a slot machine like handle which, when activated, spins the reels; sensing the material from which the beverage container was made; tilting the platform in one direction if the beverage container is metallic so as to cause the metallic container to enter a metallic container destruction means or tilting the platform in another direction if the beverage container is plastic so as to cause the plastic container to enter a plastic container destruction means; activating the destruction means which destroys the used beverage container; and dispensing an article simultaneously with the destruction of the container.

2. Apparatus for disposing of, and compacting used beverage containers comprising: a housing designed to simulate the appearance of a slot machine; a tiltable platform suitable to hold a beverage container; a beverage container resting upon said platform; means to sense the material of which the beverage container is formed; means to tilt the platform in a first direction so as to cause the beverage container to enter a metallic beverage container destruction means if the beverage container is metallic and means to tilt the platform in a second direction if the beverage container is plastic; slot machine like reel mechanisms within said housing; slot machine like activating means suitable to activate said reels and at the same time to tilt the beverage container platform destruction apparatus located within said housing; and article dispensing means activated by said slot machine like activating means.

* * * * *